US005399110A

United States Patent [19]

Morello et al.

[11] Patent Number: 5,399,110

[45] Date of Patent: Mar. 21, 1995

[54] TWO PIECE MALE PIN TERMINAL

[75] Inventors: John R. Morello, Lake Milton; Edward M. Bungo, Cortland, both of Ohio; Thomas R. Nichols, Apple Valley, Calif.

[73] Assignee: General Motors Corporation, Detroit, Mich.

[21] Appl. No.: 191,699

[22] Filed: Feb. 4, 1994

[51] Int. Cl.[6] ..... H01R 4/18

[52] U.S. Cl. ..... 439/879; 439/891

[58] Field of Search ..... 439/879, 891, 877, 878, 439/880–882

[56] References Cited

U.S. PATENT DOCUMENTS

| | | | |
|---|---|---|---|
| 1,575,656 | 3/1926 | Stratford et al. | 439/879 |
| 2,881,406 | 5/1959 | Arson | 439/589 |
| 3,721,943 | 3/1973 | Curr | 439/877 |
| 4,072,394 | 2/1978 | Waldron et al. | 439/879 |
| 4,120,556 | 10/1978 | Waldron et al. | 439/879 |
| 4,209,221 | 6/1980 | Chupak et al. | 439/848 |
| 4,527,851 | 7/1985 | Gallusser et al. | 439/271 |
| 4,784,617 | 11/1988 | Oda | 439/595 |
| 4,913,678 | 4/1990 | Avellino et al. | 439/891 |
| 5,035,655 | 7/1991 | Hesse | 439/699 |
| 5,100,346 | 3/1992 | McCardell | 439/595 |

*Primary Examiner*—Gary F. Paumen
*Attorney, Agent, or Firm*—William A. Schuetz

[57] ABSTRACT

A two piece male terminal having a contact member and an attachment member. The contact member has a round solid pin at its forward end portion, an integral collar defining a radially extending abutment at its mid-portion and a round clamping portion behind the collar and a flattened rearward end portion. The attachment member has an attachment portion at its forward end portion that is tightly clamped around the clamping portion of the contact member and a cable attachment means at the rearward end portion which receives the flattened rearward end portion of the contact member so that the flattened end portion engages the cable at its core when the two piece terminal is attached to the cable. In addition, the clamping portion of the contact member is swedged to define a post extending radially outwardly of the outer surface of the clamping portion and the attachment member has a slot which receives the post when it is rolled onto the clamping portion. The post is coined to define a flange which engages the attachment member at locations surrounding the slot to securely retain the attachment member to the contact member.

5 Claims, 2 Drawing Sheets

TWO PIECE MALE PIN TERMINAL

The present invention relates to male pin terminals and, more particularly, to a two piece male pin terminal comprising a contact member having an upset collar for locking behind a flex finger on a connector housing and a cable attachment member which is crimped onto a cable and the contact member and which has a slot for receiving a swaged post on the contact member to securely retain the two members together. Assignee's U.S. Pat. No. 5,348,498 issued Sep. 20, 1994, which is a division of U.S. Pat. No. 5,252,088 issued Oct. 12, 1993, discloses a novel two piece male pin terminal 26. It comprised a contact member 68 and an attachment member 70, both of which were made of electrically conductive material, such as brass. The contact member 68 had a round solid pin 72 at one end and had a round point to facilitate insertion of the male terminal into terminal cavities 40 of a connector and through sealing hole 64 and membrane 66 of an insert 24. The medial portion of the contact member 68 had an integral collar 74 and the opposite end had a round clamping section 76 behind the collar 74 and a flattened dished end 78. The integral collar 74 and clamping section 76 were used for securing the contact member 68 and the attachment member 72 together.

The attachment member 70 was a sheet metal stamped blank that had a generally rectangular attachment portion 80 at one end, a medial transition neck 82 and a conventional core and insulation crimp portion 84 at the other end. The attachment portion was rolled into a cylinder having a hollow circular rib 86 at one end that was formed around the collar 74 and a hollow circular rib 88 at the other end that is spaced from the hollow circular rib 86 to form a circular groove 41 that is used to lock the male terminal in the connector body, the connector body 22 having a deflectable finger which is received within the circular groove 41. The section of the rolled attachment portion 80 between the hollow ribs 86, 88 clamps around the clamping section 76 of the contact member 68 tightly. The core and insulation crimp portion 84 of the blank was formed as an open U-shape channel. The flattened dish end of the contact member 68 lies in the bottom of the channel when the attachment member 72 is crimped to the contact member 68 so that the core of an electric cable is pressed against an upper surface of the flattened dished end 78 when the channel is crimped about the cable.

Although the two piece male terminal of the aforementioned application has been highly satisfactory, it requires that the attachment member be roll formed around the collar of the pin. This requires complicated tooling and makes it more difficult to hold close tolerance limitations in the collar area.

The present invention is directed to an improved two piece male terminal in which a cylindrically shaped male contact member has an upset collar to define a radially extending rearward facing abutment surface and a cylindrical clamping portion adjacent the radially extending abutment surface which is swaged to define a depression extending radially inwardly from its outer surface and with the material from the swaged depression forming a post extending radially outwardly of the outer surface. The attachment member has a cylindrical attachment portion which is rolled around the clamping portion of the contact member and which has aligned notches defining a slot which receives the post on the clamping portion of the contact member. The post is thereafter coined down to provide a flange for engaging the rolled attachment portion at locations surrounding the slot to securely retain the attachment member to the contact member. In addition the rolled cylindrical attachment portion is spaced from the upset collar of the contact member so that the full radial extent of the upset collar can be used as an abutment surface for engaging a flexible finger in a connector housing to aid in retaining the male pin terminal in the connector housing.

The advantages of the two piece male terminal of the present invention are that it increases terminal retention, requires less complicated tooling to form the terminal in making the terminal, requires less material for the contact portion of the attachment member and enables the contact member to have a collar which can be more readily formed within tighter tolerance limitations.

The present invention further resides in various novel constructions and arrangement of parts, and further objects, novel characteristics and advantages of the present invention will be apparent to those skilled in the art to which it relates and from the following detailed description of the illustrated, preferred embodiment thereof made with reference to the accompanying drawings forming a part of this specification and in which similar reference numerals are employed to designate corresponding parts throughout the several views, and in which.

Figure 1:
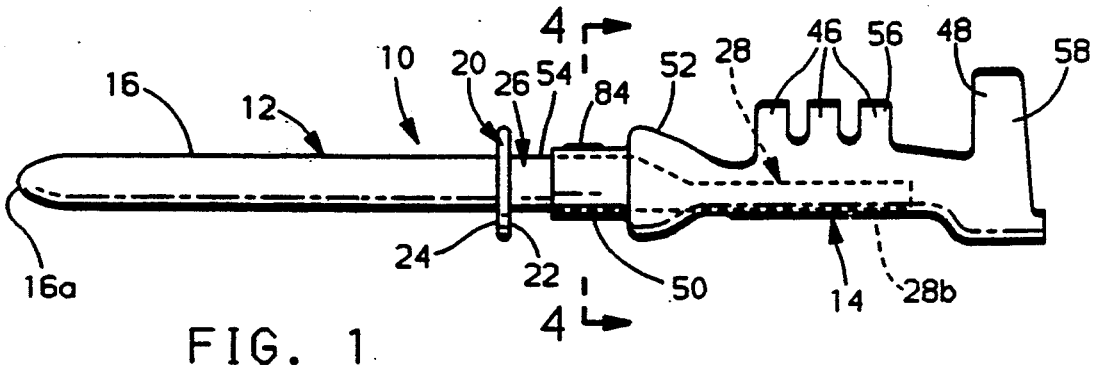
FIG. 1 is a side elevational view of the two piece male pin terminal of the present invention.
Figure 2:
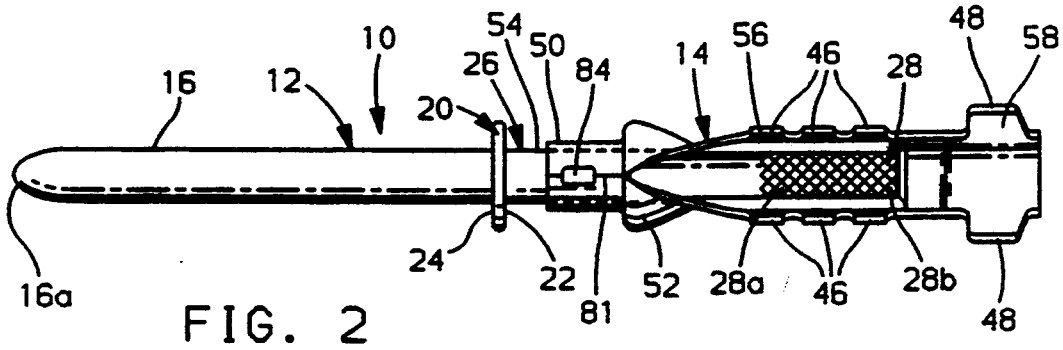
FIG. 2 is a top elevational view of the two piece male terminal of the present invention.

Referring to the drawings, a male terminal 10 is thereshown. It is of a two piece construction comprising a contact member 12 and an attachment member 14, both of which are made of an electrically conductive material, such as brass. The contact member 12 has a round or cylindrically shaped solid pin 16 along its forward portion. The pin has a round point **16*a* at its forward end to facilitate insertion of the male terminal 10** into a terminal cavity and through sealing holes and membranes of an insert, as will be hereinafter more fully described.

The contact member 12 at a medial portion is upset to define an integral collar 20. The collar 20 is disc shaped and has a radially extending abutment surface 22 at its rearward side and a radially extending surface 24 at its forward side. Both surfaces 22, 24 are perpendicular to the axis of the pin 16.

Figure 3:
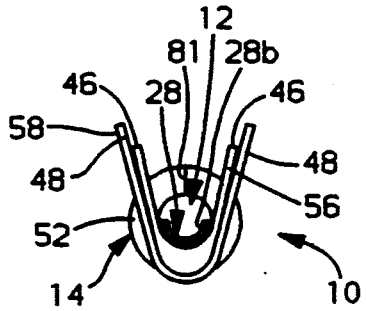
FIG. 3 is an end elevational view of the two piece male terminal assembly of the present invention.
Figure 4:
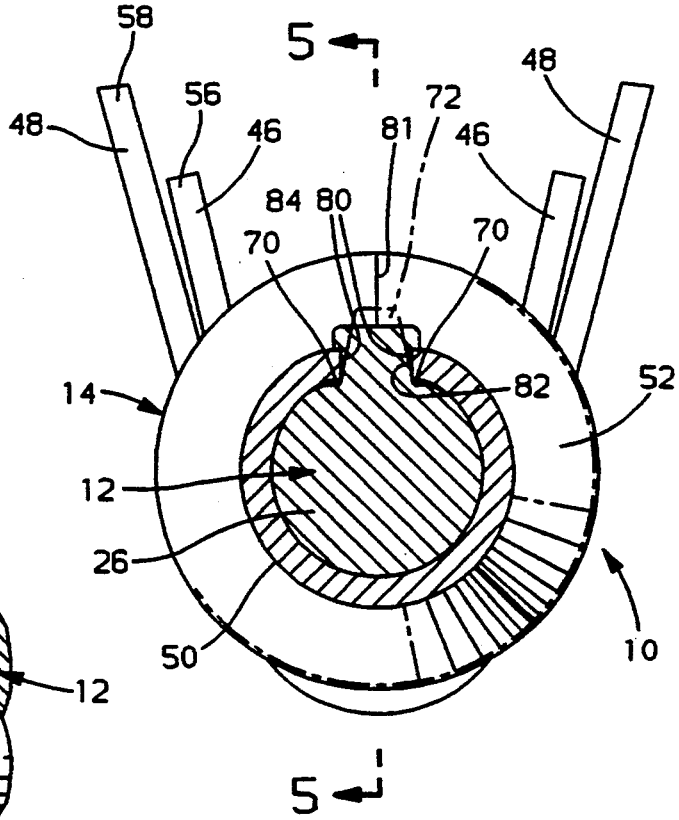
FIG. 4 is an enlarged cross-sectional view of the two piece male terminal taken approximately along line 4—4 of FIG. 1.
Figure 9:
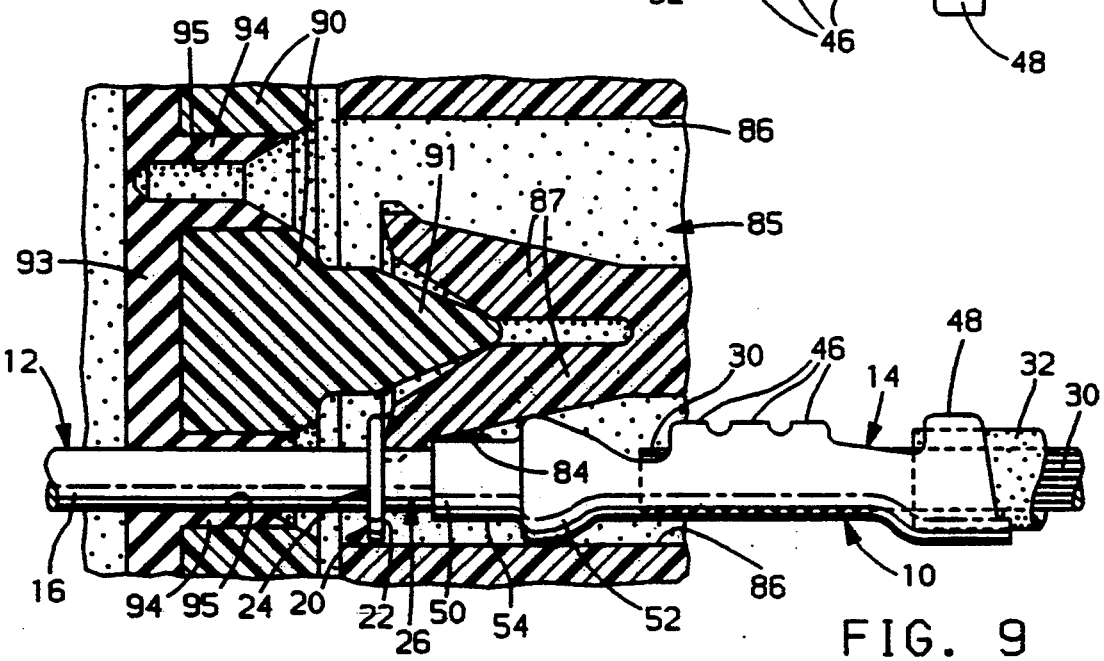
FIG. 9 is a side elevational view of the two piece male pin terminal of the present invention and showing the same connected to an insulated connector housing and to a core and insulation of a conductor cable.

The contact member 12 also has a cylindrically shaped clamping portion 26 intermediate its ends and located adjacent the radially extending abutment surface 22 of the collar 20 and a flattened and dished end 28 that is knurled on its upper surface 28*a* along its rearward portion 28*b*. Although the rearward end portion 28*b* is flattened, it is also slightly arcuate in shape, as shown in FIG. 3. The flattened and dished end 28 is used to establish good electrical contact between the contact member 12 and a conductive core 30 of an electrical conductor cable when the male terminal 10 is attached to the core 30 of an insulation end 32 of the cable, as shown in FIG. 9.

Figure 8:
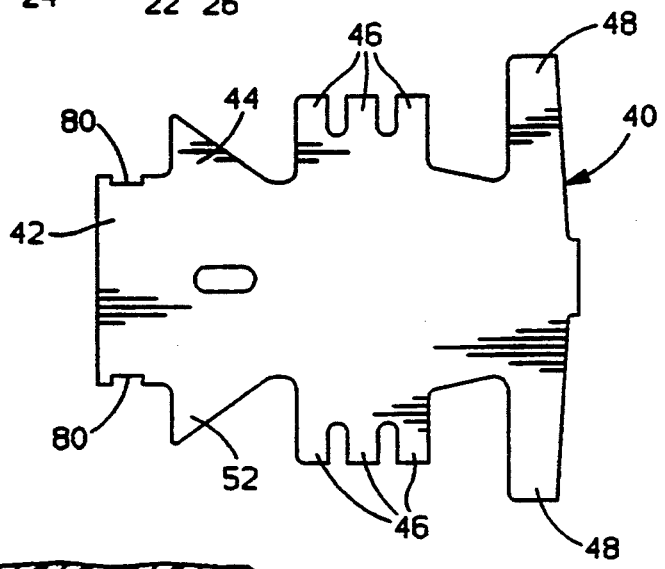
FIG. 8 is a top plan view of the metal blank for forming the attachment member of the two piece terminal of the present invention.

The attachment member 14 is made from a sheet metal blank 40 stamped to the configuration shown in FIG. 8. The stamped blank 40 that has a generally rectangular attachment portion 42 at its forward end, a medial transition connect portion 44 and a conventional core and insulation crimp portions 46, 48 at its other or rearward end. The attachment blank 40 is rolled into a cylinder 50 at its forward end that is formed around the clamping portion 26 of the contact member 12 at a location spaced rearwardly from the radially extending abutment surface 22 of the collar 20 of the contact member 12 and is also rolled so as to form a hollow circular, radially extending rib 52 that is spaced from the collar 20 and which defines with the collar 20 a circular groove 54 that is used to lock the male terminal 10 in a connector body, as hereafter more fully described. The rolled cylindrical attachment portion 50 at the forward end is located between the collar 20 and the rib 52 and clamps tightly around the clamping section 26 of the contact member 12.

The core and insulation crimping portions 46, 48 of the blank 40 are bent to form conventional, open U-shaped channels 56, 58, as shown in FIG. 3. The flattened dished end 28 of the contact member 12 lies in the bottom of the channels 56 when the attachment member 14 is attached to the contact member 12 so that the core 30 of an electrical cable 32 is pressed against the upper knurled surface 28*a* of the flattened dished end 28 when the channels 56, 58 are crimped onto the core 30 and the insulation of the cable 32, as shown in FIG. 9.

Figure 5:
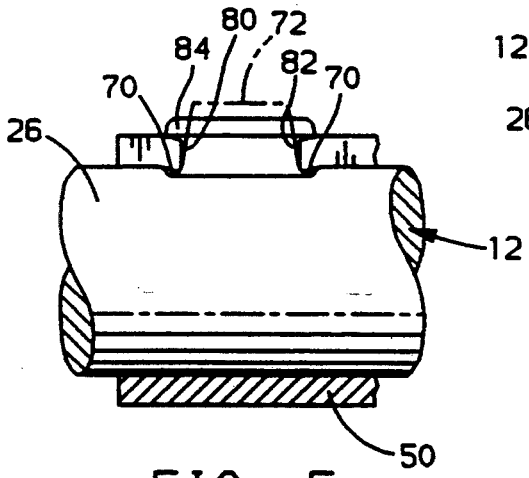
FIG. 5 is a fragmentary cross-sectional view of the two piece male terminal of the present invention taken approximately along line 5—5 of FIG. 4.
Figure 6:
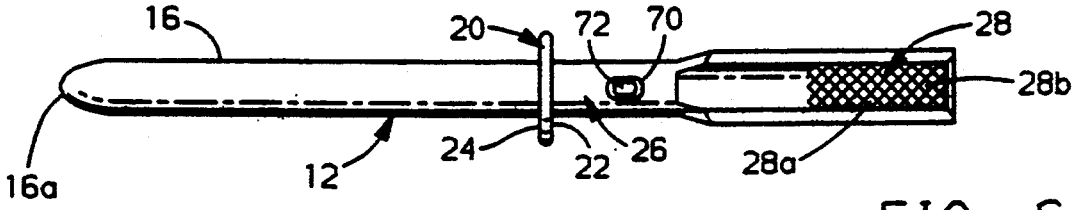
FIGS. 6 and 7 are, respectively, top and side elevational views of the contact member of the two piece male terminal of the present invention.
Figure 7:
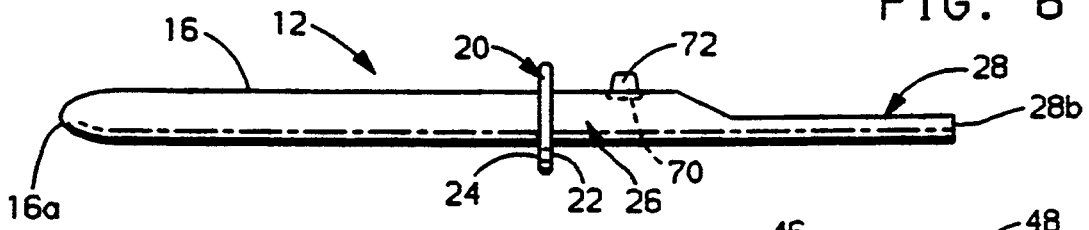

An important aspect of the present invention is the manner in which the attachment member 14 is retained on the contact member 12. As best shown in FIGS. 5 and 6, the clamping portion 26 of the contact member 12 is swaged or swedged, so as to define an annular depression 70 extending radially inwardly from the outer cylindrical surface of the clamping portion 26. The material swaged from the depression 70 is pushed and extends radially outwardly from the outer cylindrical surface of the clamping portion 26 to form a post 72 located centrally of the annular depression 70. The post 72 is preferably tapered so that its transverse dimension or diameter progressively decreases proceeding from its end adjacent the clamping portion 26 toward its outer free end. In addition, the attachment portion 42 of the attachment member blank 40 has a pair of rectangular notches 80. The attachment portion 42 when rolled to form the cylinder 50 defines a seam 81 at its adjacent axially extending side edges and the notches 80 are aligned with each other to define a slot 82 which receives the post 72 on the clamping portion 26 of the contact member 12 when the cylinder 50 is rolled onto and clamped to the clamping portion 26. After the attachment member 12 is rolled onto the clamping portion 26 of the contact member 12, the post 72 is coined or swaged down to form a flange 84 which engages the cylinder 50 of the attachment member 14 at locations surrounding the slot 82 to securely retain the attachment member 14 to the clamping portion 26 of the contact member 12. This securely holds the attachment member 14 onto the contact member 12 in addition to any clamping forces resulting from crimping the core 30 of the electric conductor. This stabilizes the connection between the contact member 12 and the attachment member 14 axially and in all directions.

As best shown in FIG. 9, the two piece male terminal 10 is adapted to be connected to a connector housing 85 having a terminal cavity 86 defined in part by a deflectable finger 87. The connector housing 85 has a plurality of through cavities 86 therethrough and with the deflectable fingers 87 being located in a side wall adjacent the cavities 86. The two piece male terminal 10 is connected to the connector housing by insertion from right to left, as viewed in FIG. 9. As the terminal 10 is inserted, the forward portion of the lock collar 20 will cam the flexible finger 87 radially outwardly until it passes the finger 87 whereupon the flexible finger will be deflected into the annular groove 54 between the collar 20 and the rib 52. It should be noted that the finger 87 can engage for the full radial extent of the lock collar 20 so that the pull out force rearward or to the right is maximized due to the larger engagement between the finger 87 and the collar 20. In the embodiment shown in FIG. 9, an insert 90 is connected to the connector housing 85 with the insert having a forwardly extending portion 91 which holds the adjacent fingers 87 apart to prevent removal of the two piece male terminal 10 from either direction, and in a manner fully described in the aforementioned patent applications Ser. Nos. 08/077,589 and 07/956,217 to which resort may be had for a full description. In addition, the connector housing has a membrane seal 93 having button portions 94 whose openings 95 have a smaller diameter than the diameter of the pin 16 to sealingly engage the male terminals 10.

From the foregoing, it should be apparent that a novel, two piece electrical terminal has been provided in which tolerance limits on an upset collar can be closely maintained, maximum engagement between the flexible finger 87 and the collar 20 is permitted and wherein the attached member 14 of the two piece terminal does not require as much material as the attachment member shown and described in the aforementioned patent application 08/077,589 and in which the swedged retention means between the attachment member 14 and the contact member 12 insures a good tight connection between the attachment member 14 and the contact member 12, which connection also minimizes the ability of the flattened dish shaped end 28 of the contact member 12 to move radially out of position with respect to the bottom of the U-shaped crimp wings 46 as compared to the two piece terminal design of the aforementioned patent application 08/077,589.

Figure 10:
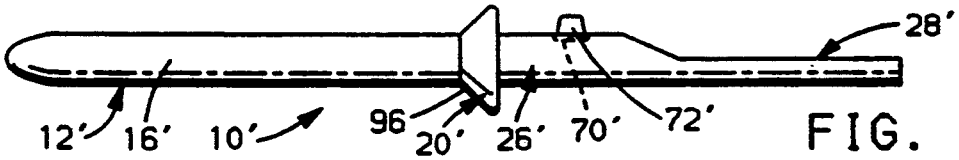
FIG. 10 is a side elevational view of an alternative contact member for the two piece male terminal.

FIG. 10 shows an alternative embodiment of a contact member 12' for the two piece male terminal. The contact member 12' differs from the contact member 12 in that it has a collar 20' which has a forwardly facing taper which progressively increases from the pin 16' to the outer diameter of the collar to define a ramp 96, which facilitates a smoother and lower engage force against the finger 87 when the contact member 12' of the terminal 10' is inserted in the cavity 86 of the connector.

Although the illustrated embodiment hereof has been described in great detail, it should be apparent that certain modifications, changes and adaptations may be made in the illustrated embodiment, and that it is intended to cower all such modifications, changes and adaptations which come within the spirit of the present invention.

The embodiments of the invention in which an exclusive property or privilege is claimed is defined as follows:

1. A two piece male pin terminal comprising:

a contact member that is made of an electrically conductive material and an attachment member;

the contact member having a round solid pin at its forward end portion, an integral collar defining a radially extending abutment at a midportion, a round clamping portion behind said collar and a flattened rearward end portion;

said clamping portion being swaged to define a post extending radially outwardly of said outer surface of the clamping portion;

the attachment member having a rolled cylindrically shaped attachment portion at its forward end portion that is clamped around the clamping portion of the contact member, said cylindrical attachment portion defining a seam along its adjacent edges and having notch means defining a slot for receiving said post when the attachment portion is rolled to a cylindrical shape, said post being coined to define a flange for engaging said cylindrically shaped attachment portion at locations surrounding said slot to securely retain the attachment member to said contact member, said attachment member having a cable attachment means at its rearward end portion which receives the flattened rearward end portion of the contact member so that the flattened end portion engages a cable at its core when the two piece terminal is attached to a cable.

2. A two piece male pin terminal comprising:

a contact member that is made from an electrically conductive material and an attachment member made from an electrically conductive material;

the contact member having a cylindrically shaped solid pin along its forward portion, a solid integral collar defining a radially extending abutment at a midportion, a solid cylindrical shaped clamping portion behind said collar and a flattened rearward end portion;

the attachment member having a rolled cylindrically shaped attachment portion at its forward end that is clamped around the clamping portion of the contact member and a cable attachment portion at its rear end which receives the flattened rearward end portion of the contact member and which engages a core of a wire cable when the two piece terminal is attached to the cable, the improvement being that the clamping portion of the contact member is swaged to define a depression extending radially inwardly from its outer surface and with the material from the swaged depression forming a post extending radially outwardly of said outer surface of said clamping portion and that the cylindrical attachment portion of the attachment member has a seam along its adjacent edges and a pair of aligned notches which together define a slot for receiving said swaged post when the attachment portion is rolled to a cylindrical shape, said post being coined down to define a flange engaging said cylindrical attachment portion at locations surrounding said slot therein to securely retain said attachment member to said contact member.

3. A two piece male pin terminal comprising:

a contact member that is made from an electrically conductive material and an attachment member made from an electrically conductive material;

the contact member having a cylindrically shaped solid pin along its forward portion, a solid integral collar defining a radially extending abutment at a midportion, a solid cylindrical shaped clamping portion behind said collar and a flattened rearward end portion;

the attachment member having a cylindrically shaped attachment portion at its forward end that is rolled and clamped around the clamping portion of the contact member and a cable attachment portion at its rear end which receives the flattened rearward end portion of the contact member and which engages a core of a wire cable when the two piece terminal is attached to the cable, the improvement being that the clamping portion of the contact member is swaged to form a post extending radially outwardly of said outer surface of said clamping portion, that the cylindrical attachment portion has a forward end which is spaced rearwardly from said radial abutment on said collar and that the cylindrical attachment portion of the attachment member defines a seam long its adjacent edges and a pair of aligned notches which together define a slot for receiving said swaged post when the attachment portion is rolled and clamped to the clamping portion, said post being coined down to define a flange engaging said cylindrical attachment portion at locations surrounding said slot to securely retain said attachment member to said contact member.

4. A two piece male terminal as defined in claims 1, 2 or 3 and wherein said collar has a tapered forward end portion whose taper progressively increases proceeding from its forward end to its rearward end.

5. A two piece terminal, as defined in claims 1, 2 or 3, and wherein said collar is in the shape of an annular disc.

* * * * *